United States Patent [19]

Butner

[11] 4,440,397

[45] Apr. 3, 1984

[54] TAX BOARD GAME

[76] Inventor: Alfred N. Butner, 14565 Harvard Ct., Los Altos Hills, Calif. 94022

[21] Appl. No.: 340,126

[22] Filed: Jan. 18, 1982

Related U.S. Application Data

[63] Continuation of Ser. No. 228,619, Jan. 26, 1981, which is a continuation of Ser. No. 36,182, May 4, 1979, abandoned.

[51] Int. Cl.[3] ..... A63F 3/00

[52] U.S. Cl. ..... 273/256

[58] Field of Search ..... 273/256, 254, 278

[56] References Cited

U.S. PATENT DOCUMENTS

| | | | |
|---|---|---|---|
| 2,174,058 | 9/1939 | McGennis | 273/256 |
| 3,865,380 | 2/1975 | Thomas | 273/256 |
| 3,874,671 | 4/1975 | Smith | 273/256 X |

FOREIGN PATENT DOCUMENTS

| | | | |
|---|---|---|---|
| 2330420 | 6/1977 | France | 273/256 |

OTHER PUBLICATIONS

"Stick the IRS", Forbes Magazine, Dec. 7, 1981, p. 156.

*Primary Examiner*—Richard C. Pinkham
*Assistant Examiner*—Scott L. Brown
*Attorney, Agent, or Firm*—Gerald L. Moore

[57] ABSTRACT

A tax game comprising a board having a series of marked spaces forming a path through which markers can be moved in accordance with indications on dice and using two sets of money, taxable and non-taxable. The path around the board represents a time period of one year through which various tax situations can occur as directed by cards being drawn from three card piles as required with the marker landing on certain predetermined spaces around the track. Money, taxable and non-taxable, is received or paid in accordance with the various tax transactions and income taxes are calculated with the passing of each year as indicated by the traversing of the complete path around the board.

2 Claims, 7 Drawing Figures

44 = AUDIT
37 = CREDIT
49 = AUCTION
31 = FINANCIAL OPPORTUNITY

44 = AUDIT
37 = CREDIT
49 = AUCTION
31 = FINANCIAL OPPORTUNITY (FINANCIAL OPPORTUNITY)

| | | |
|---|---|---|
| 33 EXTRA BUSINESS SUPPLIES PURCHASED AT YEAR END. VALUE $10,000 SAVINGS 10,000 THIS YEAR EXCHANGE $10,000 RED FOR $10,000 GREEN | 34 NEW JOB INCREASES YOUR INCOME $10,000 PER YEAR RECEIVE $10,000 RED | 35 STOCK DIVIDEND $10,000 LONG TERM CAPITAL GAIN 60% EXCLUDED RECEIVE $9,000 GREEN |
| SORRY-LOSS IN SALE OF HOME AND BUYING NEW ONE DISALLOWED. JOB CHANGE NOT A LEGAL DEDUCTION PAY $40,000 GREEN | HOW COULD YOU RECEIVE $10,000 GREEN FOR RE-PORTING YOUR NEIGHBOR TO IRS. PERSON TO RIGHT DRAWS AN AUDIT CARD. | INHERITED RAW LAND VALUE TO FATHER $2,000 VALUE NOW $30,000 PAY CAPITAL GAINS TAX ON $28,000 ($2,800) RECEIVE 24,200 GREEN |
| 36 DIVORCED YOU ARE SINGLE AGAIN AND YOUR TAX STATUS CHANGES. | OIL WELL PAYING OFF. RECEIVE $8,0001YR $10,0002YR $12,0003YR TAXABLE GAINS (GREEN) $7,000 1ST YR $9,000 2ND YR 10,000 3RD YR | YOU NOW RECEIVE DISABILITY PAY FOR ARMY INJURY. RECEIVE $5,000 PER YEAR-GREEN. |
| YOUR MUNICIPLE BONDS BRING TAX FREE INTEREST OF $10,000 PER YEAR RECEIVE $10,000 GREEN PER YEAR. | STOCK DIVIDEND $10,000 RED SHORT TERM GAIN-TAXABLE AT YOUR INCOME LEVEL. | PAID TOO MUCH STATE TAX LAST YEAR TAXABLE AS INCOME THIS YEAR. RECEIVE $5,000 RED |
| END OF YEAR SHIFT OF INCOME TO NEXT YEAR. SAVINGS $20,000 TAXABLE AS INCOME NEXT YEAR | DIVERT INCOME FROM RENTAL PROP-ERTY TO CHILDREN. $1,000 PER CHILD PER YEAR. SAVINGS $3,000 PER YEAR EXCHANGE $3,000 RED FOR $3,000 GREEN | STOCK SALE $10,000 SHORT TERM GAIN TAXABLE AT YOUR INCOME LEVEL RECEIVE $10,000 RED |

FIG. 5.

(CREDIT)

39

T BILL FUTURES

BOUGHT LONG (1) DUE JUNE 1 SOLD SHORT (1) DUE DEC. 1
VALUE $2,575 TAX SHELTER
EXCHANGE $2,500 RED FOR $1,500 GREEN

40

CAN NOW CLAIM TAX CREDIT FOR UP TO 20% OF CHILD CARE EXPENSES-YOUR SPOUSE JUST GOT A JOB $400 FOR 1 $800 FOR 2
EXCHANGE $1,000 RED FOR $1,000 GREEN

41

SAVE THIS CARD
"SUPER KEOGH" DEFINED BENEFIT PLANS PERMIT ANNUAL CONTRIBUTION UP TO $17,500 YEARLY.
EXCHANGE UP TO $17,500 RED FOR $17,500 GREEN

SAVE THIS CARD

YOUR SPOUSES BUSINESS ALLOWS KEOGH PLAN. SAVINGS THIS YEAR $7,500 AND ALL FUTURE YEARS.
EXCHANGE $7,500 RED FOR $7,500 GREEN YEARLY

MEDICAL AND DENTAL DEDUCTIONS FOR YEAR $3,000
CONVERT $3,000 RED TO $1,500 GREEN

TAX CREDIT FOR ENERGY SAVING SOLAR HEATING INSTALLED. HOME WAS INSULATED $2,000
@30%=$600 $8,000
@20%=$1600
$2,200 SAVINGS
CONVERT $2,200 RED TO $2,200 GREEN

GIFT TO COLLEGE AND RELIGIOUS GROUP WAS $5,000. DEDUCTIBLE $5,000. SAVINGS $5,000.
EXCHANGE $5,000 RED FOR $2,500 GREEN

INTEREST PAY ANNUALLY ON LUXURY HOME $10,000
SAVINGS $10,000 ON TAXES.
EXCHANGE $10,000 RED FOR $5,000 GREEN

STOCK TRANSFER

YOU MAY TRANSFER STOCK TO FAVORITE CHARITY
VALUE $5,000 CREDIT
CONVERT $10,000 RED TO $5,000 GREEN

STOCK LOSS $10,000 SHORT TERM. MAY CREDIT TOTAL VALUE AGAINST ORDINARY INCOME.
EXCHANGE $10,000 RED FOR $5,000 GREEN

NEW BABY IN FAMILY ADD ONE DEPENDENT. TAX SAVINGS $1,000 CREDIT.
CONVERT $1,000 RED TO $500 GREEN

GIVE PART OF YOUR LIBRARY TO HOSPITAL LIBRARY. DONATION APPRAISED VALUE $7,000 RULED TANGIBLE ASSET TO CHARITY. FULL DEDUCTION
RECEIVE $7,00 GREEN

SAVE THIS CARD

THAT ARMY INJURY NETS YOU $5,000/YEAR TAX FREE DISABILITY PAYMENT.
RECEIVE $5,000 GREEN YEARLY

YOU SELL STOCK RECEIVED AS GIFT 12 YEARS AGO.
VALUE $20,000
ORIG. COST $40,000
LOSS DEDUCTIBLE $20,000
RECEIVE $4,000 TAX CREDIT-GREEN

YOU JUST GOT MARRIED. THIS PLACES YOU IN A NEW TAX CATERGORY.

FIG. 6.

(AUDIT)

46

THE FINE FOR SPEEDING TICKET IS NOT A CONTRIBUTION TO THE CITY.
PAY $500 GREEN FOR $1,000 RED

47

YOUR PARROT "HERBERT" IS NOT ALLOWABLE AS A DEPENDENT-BIRD BRAIN.
PAY $1,000 GREEN FOR $2,000 RED

48

PAYMENT TO DR. ZILCH IS NOT ALLOWED AS A MEDICAL EXPENSE. HE IS A VETERINARIAN. YOU ARE IN DOGHOUSE.
PAY $500 GREEN FOR $1,000 RED

THE INTEREST PAID ON LOAN TO BUY MUNICIPAL (TAX FREE) BONDS IS NOT DEDUCTIBLE.
PAY $5,000 GREEN FOR $10,000 RED

SECRETARIAL FEE AT MEETING DISALLOWED. SERVICES WERE NOT SECRETARIAL.
PAY $2,000 GREEN FOR $4,000 RED

TRAVEL EXPENSES TO LONDON DISALLOWED.
PAY $2,000 GREEN FOR $4,000 RED

ENTERTAINMENT EXPENSES DISALLOWED. BUSINESS NOT FURTHERED BY EXPENDTURE.
PAY $500 GREEN FOR $1,00 RED

AUTOMOBILE EXPENSES DISALLOWED
PAY $1,000 GREEN OR $2,000 RED

"FORGOT" IS NOT REASONABLE CAUSE FOR NOT FILING RETURN LAST 2 YEARS.
PAY $15,000 + $5,000 PENALTY.
TOTAL $20,000 GREEN OR $40.000 RED

SORRY-FREE GOVERNMENT PUBLICATIONS DO NOT CONSTITUTE A CHARITABLE CONTRIBUTION TO LIBRARY.
PAY $1,000 GREEN OR $2,000 RED

DEDUCTION FOR TAXES ON FUEL TO TRAVEL TO AND FROM OFFICE DISALLOWED-
PAY $500 GREEN OR $1,000 RED

YOU WON! THE AVIATION FUEL TAX FOR YOUR CROP DUSTER IS RETURNED.
RECEIVE $2,000 GREEN

CHARITY DEDUCTION DISALLOWED-NOT APPROVED ORGANIZATION.
PAY $3,000 GREEN OR $6,000 RED

BOOZE MONEY GIVEN YOUR BROTHER-IN-LAW NOT DEDUCTIBLE. AS CHARITABLE CONTRIBUTION
PAY $2,000 GREEN FOR $4,000 RED

CHURCH CONTRIBUTION OF $2,500 DISALLOWED BECAUSE OF LACK OF RECEIPTS.
PAY $2,500 GREEN OR $5,000 RED

FIG. 7.

TAX BOARD GAME

This is a continuation of application Ser. No. 228,619 filed Jan. 26, 1981 which is a continuation of application Ser. No. 036,182, filed May 4, 1979, and since abandoned.

BACKGROUND OF THE INVENTION

The overall purpose of the subject game is to entertain the players while still instructing them in the complicated matters of personal taxes in an enjoyable manner. The complexity of the federal and state tax laws have created a situation in which only the most knowledgeable persons have an understanding of the various tax consequences of different financial transactions. By including tax situations faced by each player on a random basis in a board game, the player is instructed in taxes while being entertained by participation in the game.

DESCRIPTION OF THE DRAWINGS

FIG. 5 shows examples of financial opportunity cards which are drawn by the players when they land on predetermined spaces;

FIG. 6 shows credit-type cards which are drawn by the players; and

FIG. 7 shows audit-type cards drawn by the players.

SUMMARY OF THE INVENTION

Figure 1:
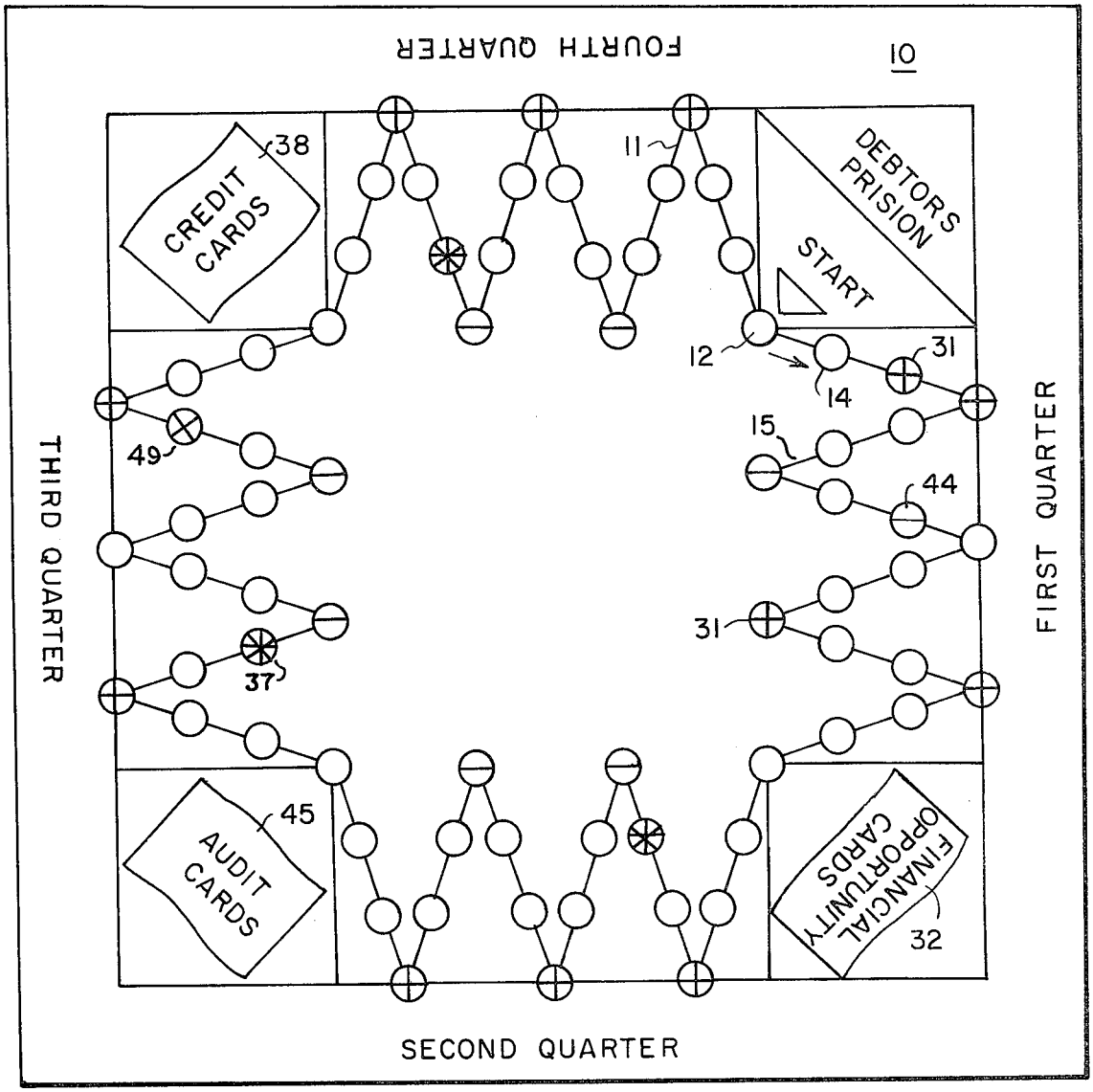
FIG. 1 is a plan view of a board suitable for playing the game.

A board game in which each player moves a marker along a predetermined path which when traversed represents one financial year. The moves are determined by the chance roll of dice and certain spaces, if landed upon, require the player to draw a card from one of a plurality of piles. These cards will instruct a change in the tax position of the player. Money representing income is given to each player as a result of the passage of one year and with the drawing of certain cards. Additionally various taxes must be calculated and paid each year and with the occurrence of the drawing of certain cards. The winner of the game is determined by counting the money retained by each player at the end of a specified period.

DESCRIPTION OF THE INVENTION

Figure 2:
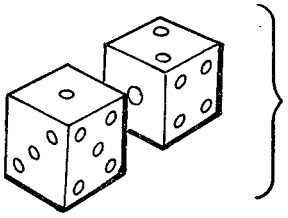
FIG. 2 shows the die used to determine the moves of the players on a chance basis.

The game is conducted on a game board 10, as shown in FIG. 1, which includes a predetermined path 11 initiating at a start point 12 and proceeding in the clockwise direction through a series of distinct spaces 14. Each space represents one move. The moves are determined by the rolling of dice such as those shown in FIG. 2. The markers (not shown) representing each player are thus moved along the line 15 between the positions until the start position is again reached. Upon returning to the start position, a financial year has transpired and the year-end taxes must be paid on income made during the moves around the board.

In one embodiment of the invention, the return of the first player to the start position indicates the end of a financial year and triggers the movement of the other players back to the start position because the calendar year or financial year for each player is the same. In the alternative, the financial year can be calculated for each player individually when they return to the start position.

Figure 4:
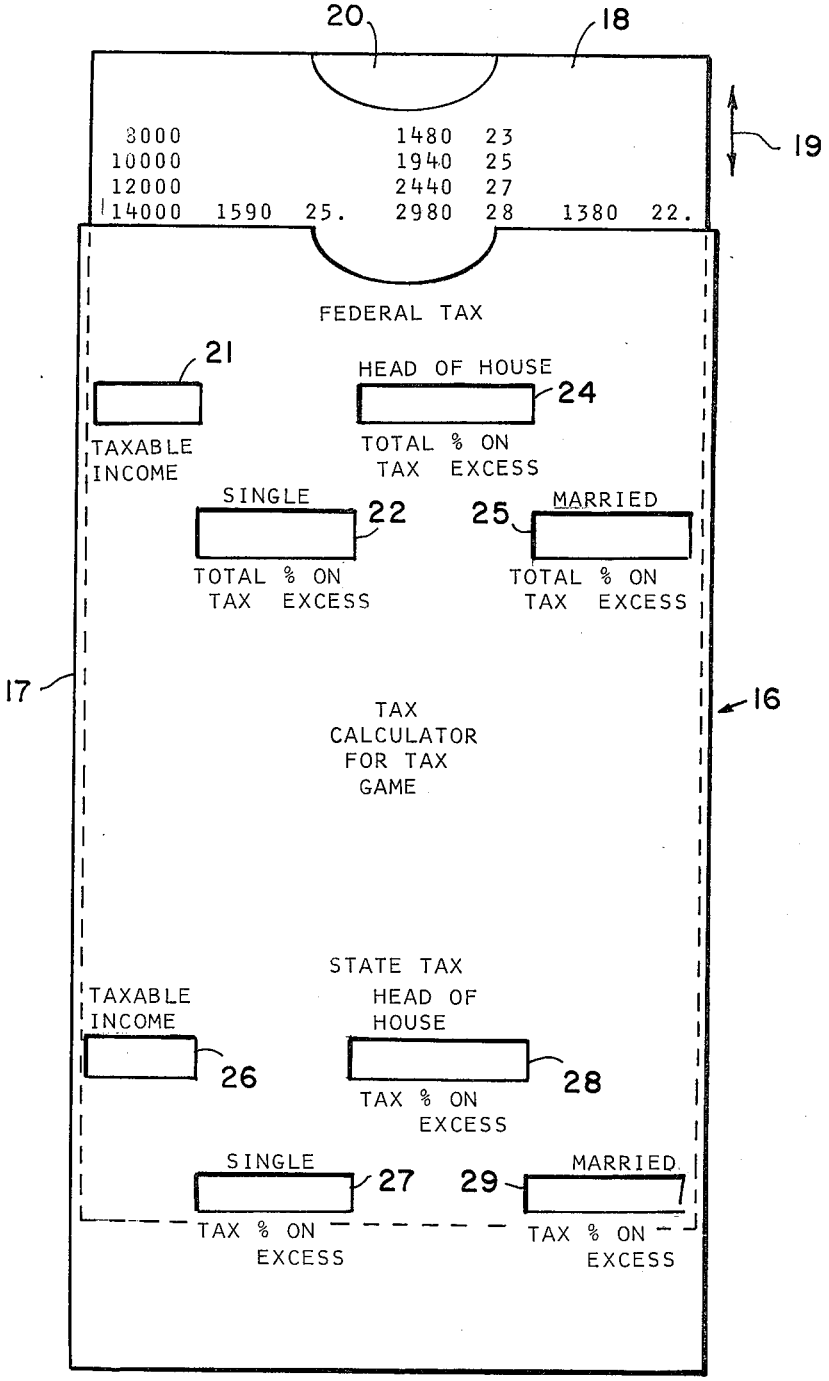
FIG. 4 is a tax calculator for calculating the personal tax of the players at various time related periods during the game.

For calculating the tax owed at the end of the year, there is provided the tax calculator 16 shown in FIG. 4. The calculator comprises a front planar member 17 and a back planar (not shown but of similar design) sandwiching therebetween a cardboard insert 18. The insert can be slid back and forth in the directions of the arrow 19 by grasping the fingerhold 20. Written on the card are columns indicating taxable income which is viewed through the slot 21 in the front plate, the federal tax calculating numbers which are viewed through the slot 22 for a single person, the federal tax for the head of household which is viewed through the slot 24 and the federal tax for married individuals which is viewed through the slot 25. Amounts representing state tax can be calculated for taxable income shown in the slot 26 with single individual amounts shown in the slot 27, head of household amounts in the slot 28 and married taxpayer amounts shown in the slot 29. Thus by sliding in the insert 18 back and forth until the taxable income appears in the slot 21 for the federal tax and slot 26 for the state tax, the tax owed by each player when passing the starting point of the game can be calculated.

Figure 3:
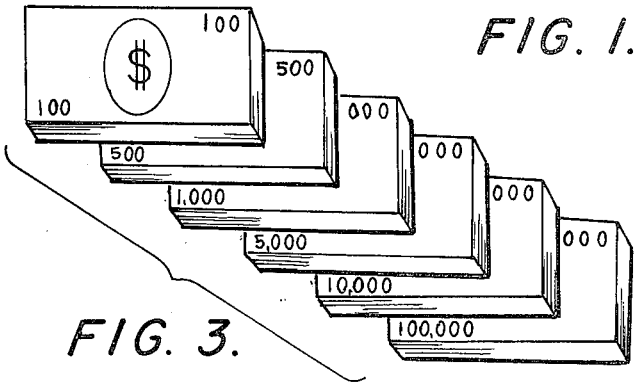
FIG. 3 shows samples of money used in the game.

Periodically each individual player is given money from the bank indicated in FIG. 3 representing annual income. The annual income can be given in one lump sum or can be doled out periodically as the player reaches specified points along the path 11.

Tax situations are encountered by requiring each player to draw cards on a chance basis. If the player marker lands on the positions 31, he is obligated to draw a card from the financial opportunity pile 32. Cards of the type included in this pile are shown in FIG. 5. Notice that for instance, card number 33 indicates that extra business supplies can be purchased at year end giving a savings of taxes on $10,000 in income. In this manner the player is permitted to exchange taxable money for nontaxable money. To determine which money is taxable and which is not, the money shown in FIG. 3 is divided into money of two different classes, taxable and that on which taxes have already been paid, i.e. money having red printing thereon and money having green printing thereon (the colors are not shown). When the player reaches each year's end, taxes are calculated on the money retained which is of the one specified color, red. The green money represents money on which taxes either are not owed or on which taxes have already been paid in prior years. Thus it is advantageous for a player to accumulate as much nontaxable or green money as possible. In the drawing of the card 32 the player is granted the advantage of exchanging taxable money for nontaxable money in like amount and taxes will be saved at year's end because the player's taxable income will be less. Similarly, if the player draws card 34 he is granted an increase in yearly income of $10,000. Thus each time the player traverses the year indicating path, i.e. returns to the start position 12, he draws of $100,000 more income than previous to receiving this card.

If the player draws from the financial opportunity pile the card 35, he is granted a stock dividend of $10,000. With taxes deducted, he thus receives $9,000 in green or nontaxable income. In a similar manner the other cards in the pile change the financial status of the player. As an example, card 36 changes the taxable status of the player from married status to divorced or single status. Thus by chance the player is granted either tax benefits or tax burdens in accordance with the cards which he draws from the financial opportunity file.

There are also included along the path the positions 37 obligating the player whose token lands thereon to draw a card from a credit pile 38. Cards in the credit pile are illustrated in FIG. 6. For instance if the player draws card 39 he is granted a $2575.00 tax shelter or entitled to exchange $2500.00 in red or taxable money for $1500.00 in green money. Card 40 allows a tax credit of up to twenty percent (20%) of gross income for child care expenses and allows an exchange of $1,000.00 in taxable money for $1,000.00 in nontaxable money. Similarly card 41 allows an annual contribution into a "super keough" plan permitting an exchange of up to $17,500.00 in taxable funds for a like amount in nontaxable money. As can be seen, these cards offer various tax opportunites to the player which for the most part are beneficial.

If the player's marker lands on one of the positions 44, he is required to draw a card from the audit pile 45. Samples of audit cards are shown in FIG. 7. In general these cards represent tax liabilities to the player. For instance, card 46 requires a payment of additional tax on $500.00 because it mandates the exchange of $500.00 nontaxable money for $1,000.00 taxable money. Such increase in taxes is dictated because of the disallowance of a contribution claimed based on declaring a fine for speeding as a contribution to the city. If the player draws card 47, the pet is disallowed as a dependent and a requirement must be met for the exchange of $1,000.00 in nontaxable money for $2,000.00 in taxable money. If the player draws card 48, a medical expense is disallowed and $500.00 in untaxable money must be exchanged for $1,000.00 in taxable money.

Thus it can be seen that as the player's marker is moved about the path by the chance roll of the dice, the landing on the various positions can change the tax status of the player. Cards from the piles 32, 38 and 45 must be drawn as a result of stopping at preselected points to dictate either tax liabilities or tax benefits. In addition, stopping on an auction block 49 allows a player to auction off cards previously obtained from the credit pile.

This tax game can be played by one or more players. During the game, each player is met with a competitive challenge of accumulating as much money as possible in light of the income granted and the taxes paid. Obviously if the tax liabilities of any player exceed the ability to pay for a specified period of time, the player loses. In addition, further embodiments of the game allow the voluntary auctioning off of certain of the beneficial cards retained to cause each player to anticipate the worth of that card to his particular situation much in the same manner as a taxpayer considers real life investments.

From the playing of this game, a competitive spirit between players is generated while instructing the individuals in the various subtleties of taxes and their impact on income retained.

The invention claimed:

1. In a board game, the combination comprising:

a marker for each player;

a board with a path for movement of the marker through predetermined spaces;

means to randomly determine the number of spaces of movement for each marker;

a supply of play money to be at least partially distributed to the players and comprising two indentifiable sets of the same type of money representing taxable and non-taxable income;

means on the board identifying the two sets of money for determining an amount of money from one or both of the two money stes to be distributed to each player whose marker lands at predetermined spaces on said board;

means for applying an individual tax status to each player including a plurality of cards indicating the tax status for that player receiving the card for all subsequent tax calculations until another event changes that status for the player;

a plurality of said predetermined spaces correlated to the cards and instructing the player landing thereon to draw one of said plurality of cards having preselected tax consequences for changing the tax status for the player whose marker lands on the spaces; a calculator for determining the taxes owed on the taxable money by each player including a tax status indicator and means to calculate the tax to be paid by each player by setting the calculator to indicate the individual tax status of the player and the taxable play money received by the player for a preceding time period and reading from the calculator the resulting tax liability; and means to assign and maintain a continuing account of the net financial worth of each player after calculating with the calculator the tax consequences of each player on a periodic basis including a determination of the play money held by each player.

2. In a board game as defined in claim 1 wherein one of said predetermined spaces is designated as year's end.

* * * * *